US006520128B2

(12) United States Patent
Hope

(10) Patent No.: US 6,520,128 B2
(45) Date of Patent: Feb. 18, 2003

(54) PISTON VALVE FOR TWO-STROKE ENGINE

(75) Inventor: Jack I. Hope, Hillsboro, OH (US)

(73) Assignee: Haeco Partners, Ltd., Hillsboro, OH (US)

( * ) Notice: Subject to any disclaimer, the term of this patent is extended or adjusted under 35 U.S.C. 154(b) by 0 days.

(21) Appl. No.: 10/166,953

(22) Filed: Jun. 11, 2002

(65) Prior Publication Data

US 2002/0148418 A1 Oct. 17, 2002

Related U.S. Application Data

(63) Continuation of application No. 09/616,258, filed on Jul. 14, 2000, now Pat. No. 6,405,691.

(51) Int. Cl.[7] ..... F02B 75/02
(52) U.S. Cl. ..... 123/65 VB; 123/47 A
(58) Field of Search ..... 123/65 VB, 65 V, 123/47 A, 47 R

(56) References Cited

U.S. PATENT DOCUMENTS 5,201,286 A * 4/1993 Kerrign ..... 123/47 A

* cited by examiner

*Primary Examiner*—Willis R. Wolfe
*Assistant Examiner*—Katrina B. Harris
(74) *Attorney, Agent, or Firm*—Wood, Herron & Evans, L.L.P.

(57) ABSTRACT

A two-stroke engine has a piston operatively connected to a crankshaft for reciprocating motion within a cylinder. An annular piston valve is mounted for slidable motion with respect to a centrally located inner body of the piston to control a flow of cycle air through the piston. A cycle air intake opening is located in a wall of the cylinder at a location above a bottom dead center position of the piston. The cycle air intake is blocked and unblocked by the reciprocating motion of the piston. A transition member located between the crankcase and the cylinder has a bore for sealingly receiving the straight body section of the connecting rod.

14 Claims, 6 Drawing Sheets

PISTON VALVE FOR TWO-STROKE ENGINE

This application is a continuation application of U.S. Ser. No. 09/616,258, entitled "Piston Valve for Two-Stroke Engine", filed Jul. 14, 2000 now U.S. Pat. No. 6,405,691, which is hereby expressly incorporated herein by reference in its entirety.

The invention was made with government support under the terms of Contract No. AMSTA-AQ-SCB awarded by Systems Development Department of the Army, United States Army Tank-Automotive & Armaments Command. The government has certain rights in the invention.

FIELD OF THE INVENTION

This invention relates to internal combustion engines and more particularly, to a piston valve for a two-stroke engine.

BACKGROUND OF THE INVENTION

In all two-stroke engines, a pressure ratio must be maintained across the intake and exhaust manifolds in order to force air through the cylinders. Such pressure ratio may be maintained by a low-pressure turbine, a Roots Blower, a turbocharger, etc. Other engines, for example, small two-stroke engines, pressurize the crankcase during a down stroke of the piston; and when the intake ports are uncovered, the pressurized crankcase forces air through the intake ports by way of a manifold external to the cylinder. During the compression stroke of the piston, a reed valve opens to allow additional air to enter the crankcase. The amount of air which is admitted to a cylinder of a two-stroke engine determines the amount of power that can be developed by the engine. In addition, the performance of a two-cycle engine is related to the ability of the engine to completely empty the cylinder of exhaust gases to permit the maximum amount of intake air to enter the cylinder.

Therefore, there is a need to provide an improved two-stroke engine in which the amount of air supplied to the cylinder is substantially increased.

SUMMARY OF THE INVENTION

The present invention provides an improved two-stroke engine that operates with substantially more cycle air and thus, produces more power. Further, the increased cycle air is effective to provide an improved scavenging of combustion gases from the cylinder. The increase in cycle air is provided by a simple, inexpensive and reliable valve mounted in a piston that is operated by pressure differentials within the cylinder.

According to the principles of the present invention and in accordance with the described embodiments, the present invention provides a two-stroke engine having a crankshaft, a cylinder, and a piston operatively connected to the crankshaft for reciprocating motion within the cylinder. An annular piston valve is mounted for slidable motion with respect to a centrally located inner body of the piston to control a flow of cycle air through the piston. A cycle air intake opening is located in a wall of the cylinder at a location above a bottom dead center position of the piston. The cycle air intake is blocked and unblocked by the reciprocating motion of the piston.

In one aspect of the invention, the connecting rod has a straight body section having a uniform cross-sectional area across its length, and a transition member located between the crankcase and the cylinder has a bore receiving the straight body section of the connecting rod. A seal is disposed between the bore and the straight body section of the connecting rod for blocking a flow of cycle air from the cylinder to the crankcase.

In another aspect of the invention, the annular piston valve is operated by pressure differentials within the bore of the cylinder; and the piston valve has an opened position providing a fluid path between forward and rear sides of the piston, and a closed position blocking the fluid path between the forward and rear sides of the piston. The annular piston valve is forced to the closed position by a greater pressure in the cylinder on the forward side of the piston as the piston moves toward and away from the top dead center position. The cycle air intake supplies cycle air into the bore of the cylinder at the rear side of the piston as the piston moves toward and away from the top dead center position; and the cycle air intake supplies cycle air into the bore of the cylinder at the forward side of the piston as the piston moves toward and away from the bottom dead center position. The annular piston valve is forced to the opened position by a greater pressure in the cylinder on the rear side of the piston as the piston moves toward and away from the bottom dead center position to supply additional cycle air within the bore of the cylinder on the forward side of the piston, thereby providing additional cycle air for compression and combustion.

In accordance with another embodiment of the invention, a method of operating a two-stroke engine includes moving a piston in a bore of a cylinder toward, through and away from a top dead center position at one end of the cylinder. A piston valve mounted for sliding motion in the piston is maintained closed by a greater pressure on a forward side of the piston caused by motion of the piston toward the top dead center position. Cycle air is received through a cycle air intake proximate a rear side of the piston at an opposite end of the cylinder. The piston in the bore of the cylinder is moved toward a bottom dead center position at the opposite end of the cylinder, and cycle air is received into the bore of the cylinder through the cycle air intake at a forward side of the piston. Simultaneously, cycle air proximate a rear side of the piston is compressed at an opposite end of the cylinder, and the piston valve is opened in response to a greater pressure on the rear side of the piston as the piston moves toward the bottom dead center position. The piston valve is maintained open in response to the greater pressure on the rear side of the piston as the piston moves through and away from the bottom dead center position to supply additional cycle air within the bore of the cylinder on the forward side of the piston, thereby improving the scavenging of combusted air from the cylinder through the exhaust valve and providing additional cycle air for compression and combustion. The piston valve is closed in response to a greater pressure on the forward side of the piston as the piston moves toward the top dead center position.

These and other objects and advantages of the present invention will become more readily apparent during the following detailed description taken in conjunction with the drawings herein.

DETAILED DESCRIPTION OF THE INVENTION

Figure 1:
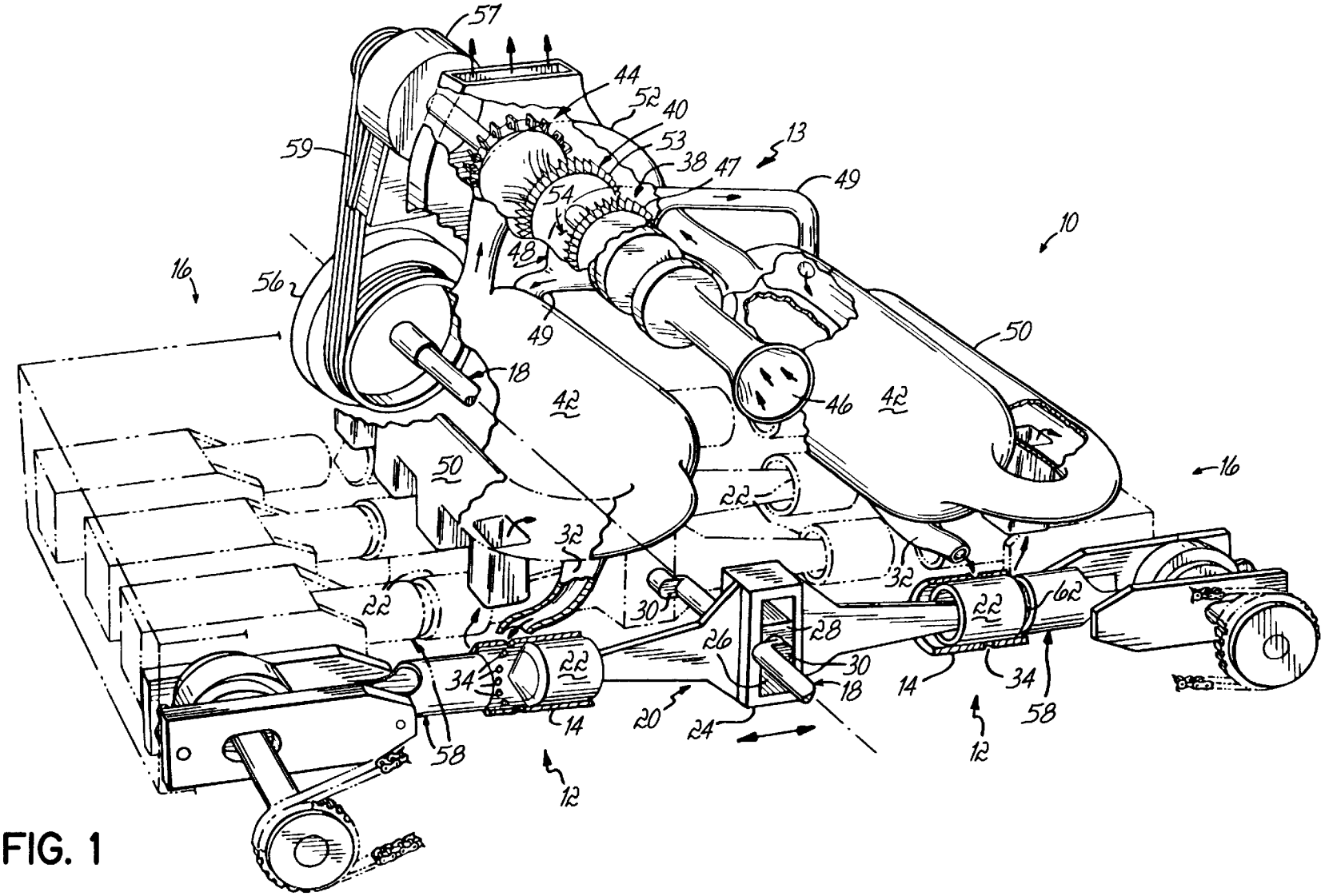
FIG. 1 is a diagrammatic perspective view of a compound engine in which a two-stoke engine with a piston valve of the present invention may be used.
Figure 2:
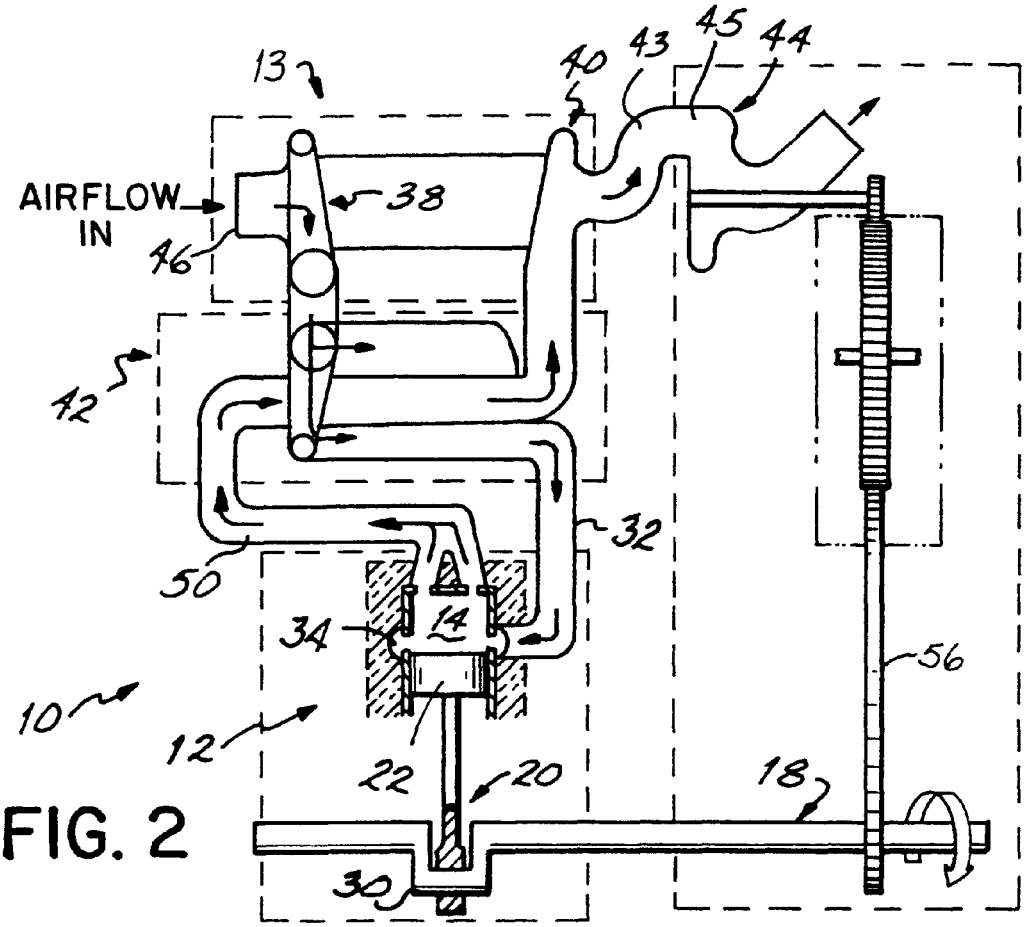
FIG. 2 is simplified schematic block diagram of the compound engine illustrated in FIG. 1.
Figure 3A:
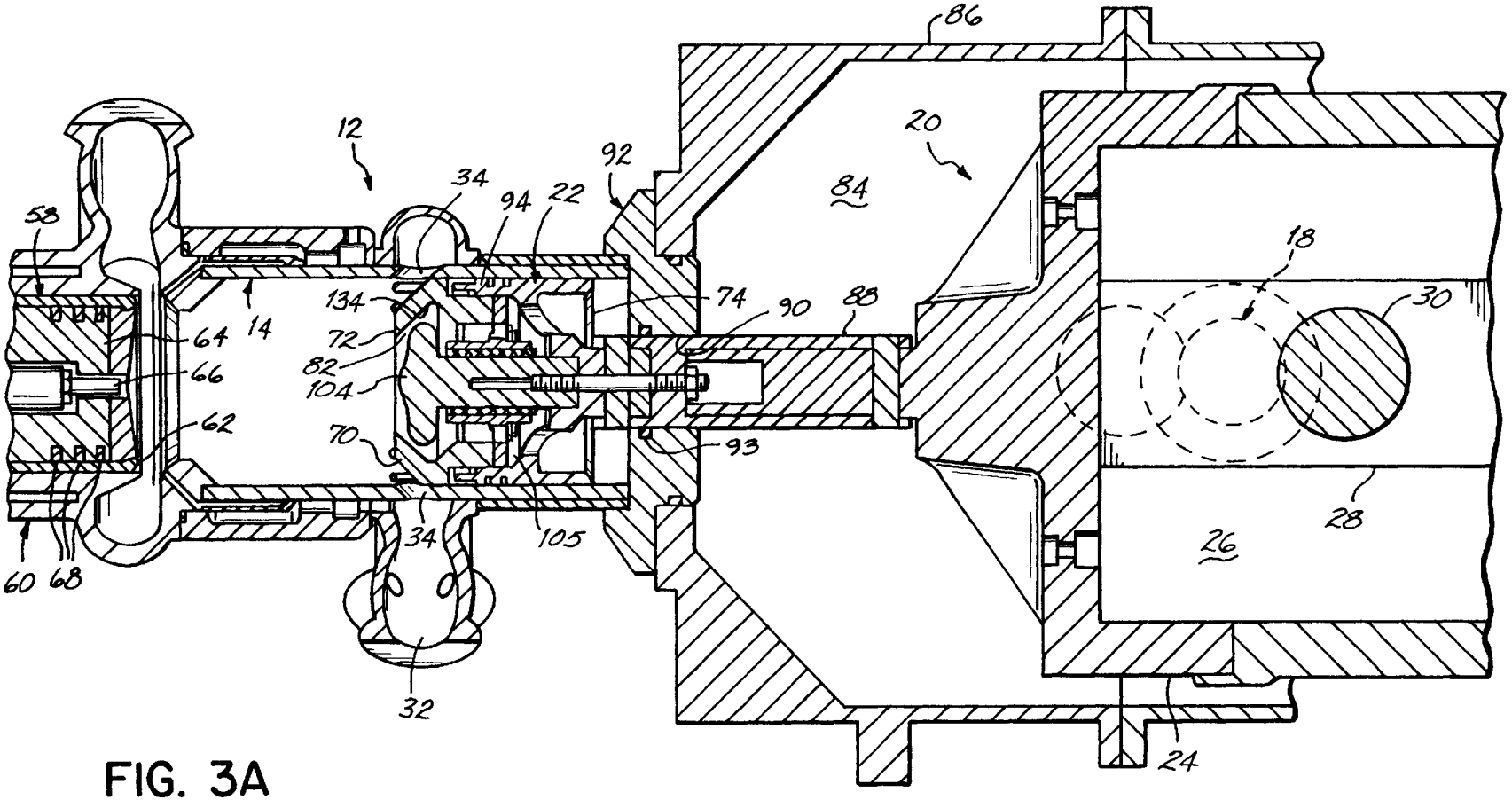
FIGS. 3A and 3B are partial cross-sectional views illustrating one of the two-stroke engines of the compound engine illustrated in FIG. 1 and a piston valve in its respective opened and closed positions in accordance with the principles of the present invention.

Referring to FIGS. 1, 2 and 3A, a compound engine 10 is comprised of a piston unit 12 combined with a gas turbine 13. In one embodiment, the piston unit 12 is a compression ignition, two-stroke, uniflow scavenge diesel engine or unit which includes opposed pairs of cylinders 14, for example, four opposed pairs of cylinders. The opposed pairs of cylinders 14 are arranged in two banks 16, one cylinder 14 of one bank 16 is directly opposite one cylinder 14 of the other bank 16. Each pair of the cylinders 14 is drivably connected to the crankshaft 18 by means of a scotch yoke 20. Each cylinder 14 contains a piston 22 rigidly connected to one end of the scotch yoke 20. The scotch yoke 20 has a crosshead 24 with a rectangular slot 26 that has a slider block 28 slidably mounted therein which is rotatably coupled to an eccentric 30 of the crankshaft 18. The cylinders 14 are generally identical, and each pair of cylinders 14 with interconnecting scotch yoke 20 is generally identical. Similarly the banks 16 of cylinders 14 are generally identical, mirror images of each other. Combustion or cycle air is fed to each cylinder 14 through an intake manifold 32 and air intake ports 34 when its respective piston 22 is in the bottommost portion of its stroke, that is as the piston 22 is moving toward and away from its bottom dead center position.

The cycle air is supplied by a high-pressure gas turbine unit 13 comprised of a steady flow, high-pressure compressor 38, a high-pressure turbine 40, a pair of combustors 42 and an axial flow, low-pressure turbine 44. The high-pressure compressor 38 receives cycle air through an inlet 46; and the air passes through vanes of a compressor rotor 47 and through a discharge scroll 48 that divides the compressed air into two discharge paths 49,49, each of which routes the air to one of the two combustors 42. The turbine unit 13 is configured such that exhaust gases from the cylinders 14 of each bank 16 of the piston unit 12 pass through one of a pair of exhaust manifolds 50, respectively associated with each bank 16, and through a respective one of the two bypass combustors 42 of the gas turbine unit 13. The combustors 42 are configured to drive the high-pressure turbine 40 by routing the exhaust gases from the combustors 42 to the two entrances on each side of the engine of a dual inlet variable area turbine nozzle scroll 52 and through the vanes of the high-pressure turbine rotor 53. The high-pressure turbine 40 output shaft is connected to a bearing and shaft assembly 54 to drivably rotate the high-pressure compressor 38. The low-pressure turbine 44 is mechanically coupled to the crankshaft 18. A flywheel 56 is also mounted on the crankshaft 18 which provides rotary shaft output power from the compound engine 10. The scotch yoke 20 is rigidly connected to the pistons 22 and the centrally located rectangular slot 26 extends longitudinally in a direction perpendicular to the stroke of the opposed pistons 22.

An exhaust valve 58 is mounted around, and moves longitudinally with respect to, a center body 64 which holds a fuel injector 66. The exhaust valve 58 has an inside lip 62 which is oriented at an angle of approximately 30° with respect to the horizontal and is used to provide a positive seating force during combustion when there is maximum pressure within the cylinder. An advantage of such a valve design is that combusted gases remaining in the cylinder during exhaust are substantially reduced. Further, depending on a combination of gas turbine and piston unit speed, the scavenge efficiency will reach one hundred percent (100%). Fuel injection is accomplished by utilizing an eight-plunger fuel pump (not shown) with cam plunger springs and governor to drive the eight fuel injectors. All eight high-pressure fuel injection lines are identical in length so that all injector needle lift pressures are approximately the same, for example, 3200 psi. Sealing rings 68 are contained on both the center body and the cylinder head 60 to seal combustion gases from leaking past the exhaust valve 58 that is reciprocating therebetween. A compound engine similar to the compound engine 10 described herein is described in detail in U.S. Pat. Nos. 5,555,730 and 5,653,108 which are assigned to the same assignee as the present application and are hereby incorporated in their entireties by reference herein.

The pressure drop across a typical two-stroke cylinder varies with the valving arrangement, speed and power setting. For a unit with a fixed displacement scavenge compressor, the pressure ratio can vary from very low values at idle to perhaps forty percent (40%) at full power and full speed. For surface applications of the compound engine 10, a 5:1 pressure ratio, high-pressure compressor 38 with an eighty-seven percent (87%) peak efficiency. The compressor efficiency is an important parameter for a gas turbine and diesel compound engine. Since the compressor 38 provides air to the piston unit at about 400° F. a lower pressure ratio will reduce the exhaust energy recovered in the low-pressure turbine 44. On the other hand, a higher pressure ratio requires the piston compression ratio to be lowered to maintain reasonable peak cylinder pressure. In addition, as the compressor ratio increases, the air temperature furnished to the piston unit 12 increases, thereby reducing the cooling capabilities of that air. Further, the temperature of the cycle air at the intake manifold has a large effect on the volumetric efficiency, or the ability of the cylinder to obtain a sufficient charge of air on each stroke.

Figure 5:
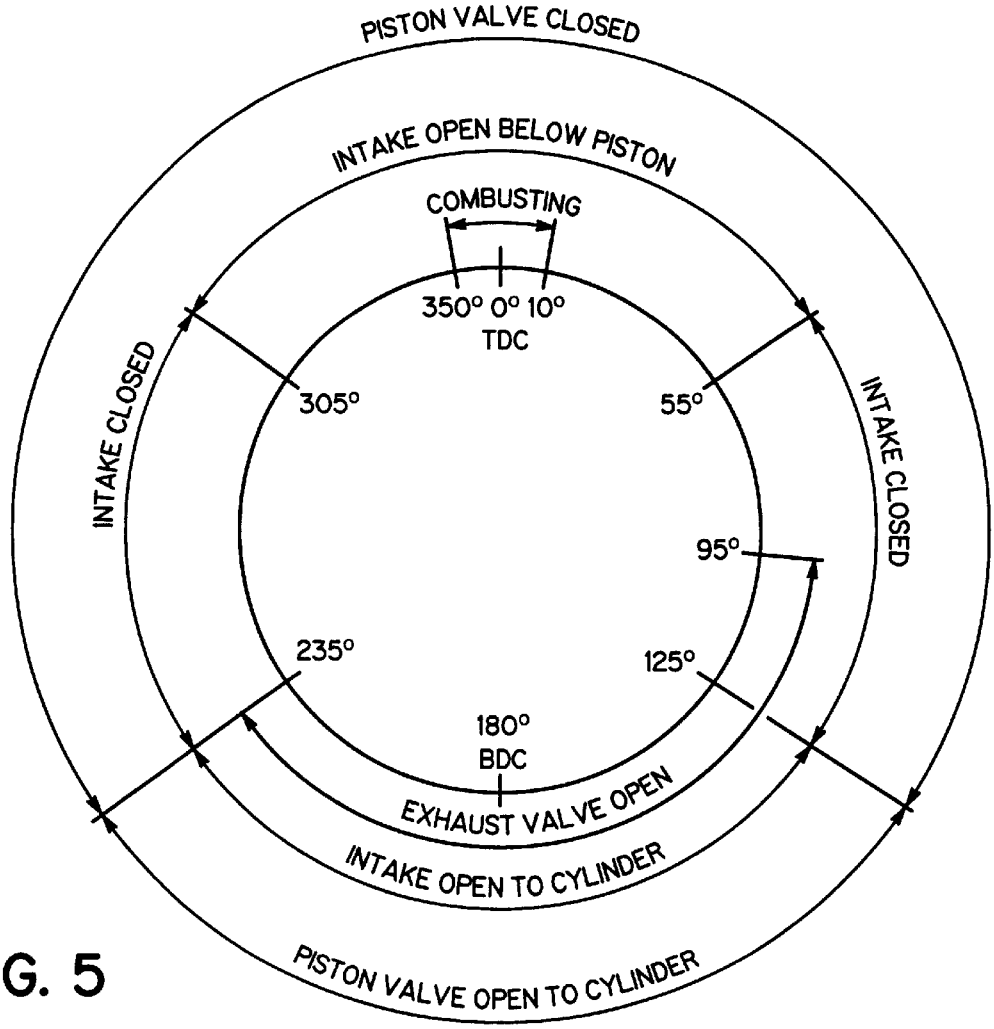
FIG. 5 is a schematic diagram illustrating the intake of cycle air, the exhaust of combusted gases and the operation of the piston valve as a function of the crankshaft position of the two-stroke engine illustrated in FIGS. 3A and 3B.

The power that can be developed by the two-stroke piston unit 12 is determined by the amount of air which is admitted to the cylinders 14. As shown in FIGS. 3A and 5, during a rotation of the crankshaft 18 of approximately 55° before and after the piston bottom dead center position, the piston 22 is below the air intake ports 34; and cycle air is admitted into the cylinder 12 at the forward side 72 of the piston 22. If the amount of cycle air admitted to the cylinder is increased, for example doubled, the pressures within the cylinder during the compression stroke would be significantly greater. Assuming the amount of fuel injected into the cylinder is optimized for the increased cycle air, the power provided by the two-stroke engine 12 would be increased.

Figure 3B:
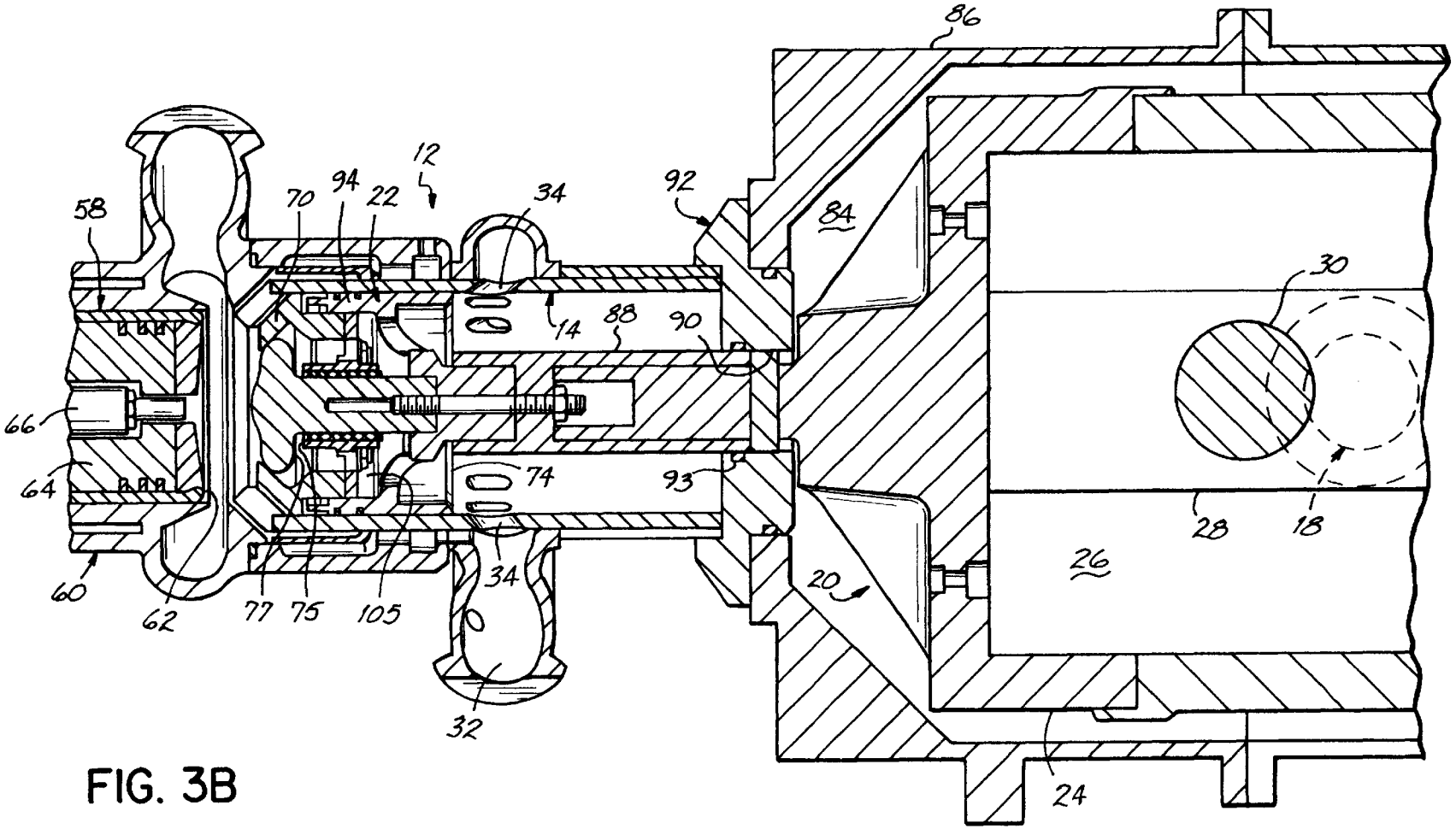
Figure 4:
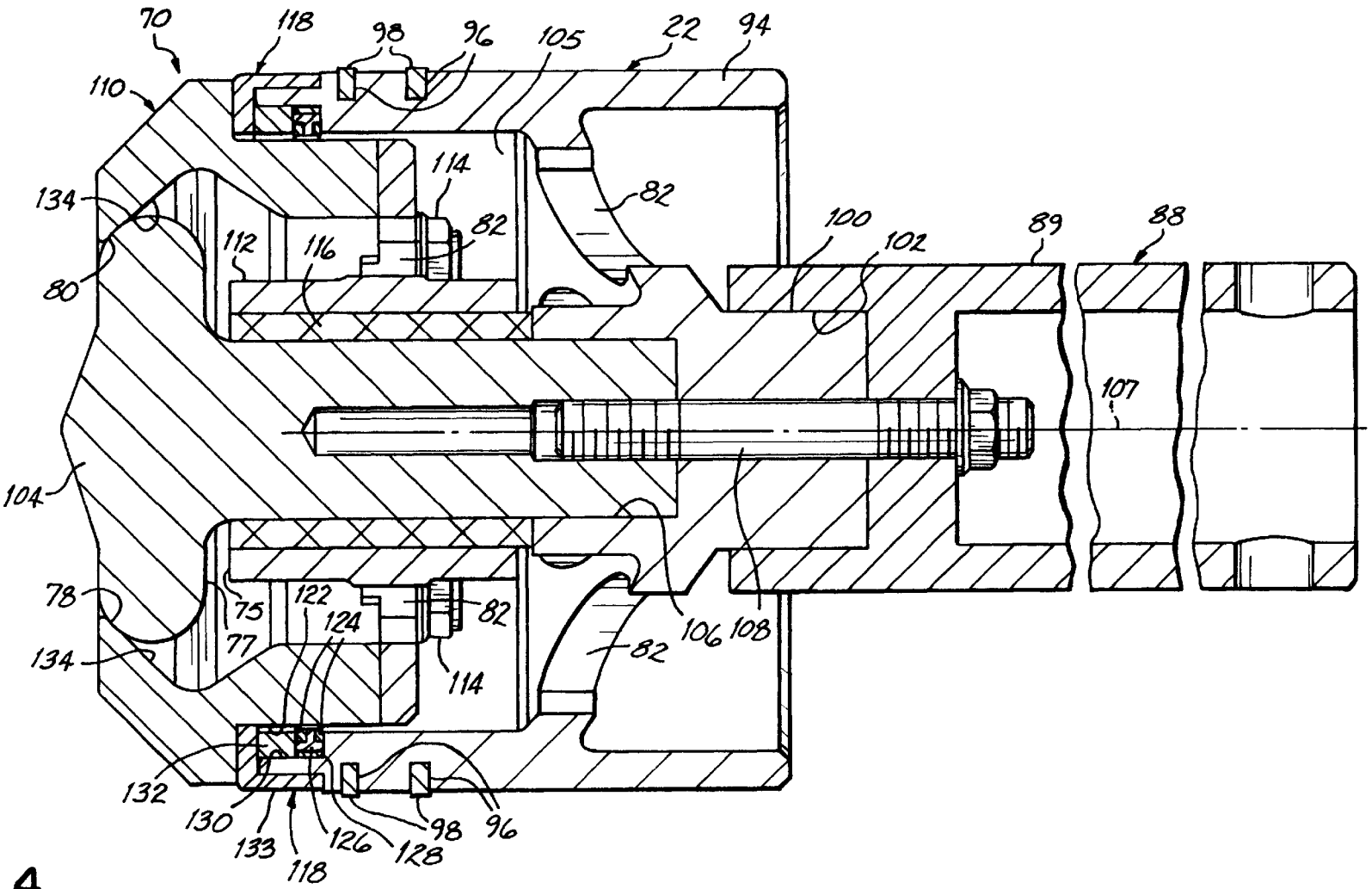
FIG. 4 is an enlarged view of the piston and piston valve illustrated in FIGS. 3A and 3B.

In order to increase the amount of cycle air introduced into the cylinder 12, a piston valve 70 is mounted within the piston 22. Referring to FIGS. 3A and 4, the piston 22 has an annular or ring-like outer body 94 connected to a centrally located inner body 104, and an annular cavity 105 is formed in the piston 22 between the outer and inner bodies 94, 104, respectively. The annular piston valve 70 is disposed within the cavity 105 and mounted for slidable motion on the inner body 104. The piston valve 70 is moved between opened and closed positions illustrated in FIGS. 3A and 3B, respectively, by pressure differentials within the cylinder 12, that is, a difference in pressure between forward and rear sides 72, 74, respectively, of the piston 22. During much of the compression and combustion strokes, while the piston 22 is moving toward and away from its top dead center position, the pressure on the forward side 72 of the piston 22 is greater than the pressure on its rear side 74. Therefore, the annular piston valve 70 is pushed firmly against the piston 22, and an annular sealing area 78 on the annular piston valve 70 is pushed against an annular sealing area or valve seat 80 on an inner body 104 of the piston 22, thereby preventing a flow of cycle air past the piston valve 70.

When the piston 22 is moving toward and away from its top dead center position, the bore of the cylinder 12 at the rear side 74 of the piston 22 is in fluid communication with, and receives cycle air from, the air intake ports 34. As shown in FIG. 5, for a period of approximately 55° on both sides of the top dead center position of the piston 22, the cylinder 12 is receiving cycle air at the rear side 74 of the piston 22. During the combustion or power stroke, as the piston 22 travels toward the bottom dead center position, the cycle air in the cylinder 12 at the rear side 74 of the piston 22 is compressed. As shown in FIG. 5, approximately 85° before the bottom dead center position of the piston 22, the exhaust valve 58 is opened, and the gases of combustion begin to be exhausted from the cylinder 12.

At approximately 55° before the bottom dead center position of the piston 22, the forward side 72 of the piston 22 passes the forward edges of the air intake ports 34, thereby further reducing the pressure on the forward side 72 of the piston 22. Normally, with the exhaust valve 58 open, when the intake ports 34 are opened to the forward side 72 of the piston 22, the pressure force on the rear side 74 of the piston 22 exceeds the pressure on the piston's forward side 72; and the annular piston valve 70 is moved upward toward its open position until an end surface 75 (FIG. 4) on the piston valve 70 strikes a stop surface 77 on an inner body 104 of the piston 22 as illustrated in FIG. 3A. When the piston valve 70 is opened, compressed cycle air on the rear side 74 of the piston 22 flows through the path 82 (FIG. 4) in the piston 22 to the portion of the cylinder 12 at the forward side 72 of the piston 22. Thus, the amount of cycle air in the cylinder 12 at the forward side 72 of the piston 22 available for compression and combustion is substantially increased.

In the above example, the piston valve 70 is described as opening at approximately 55° before the bottom dead center position. However, as will be appreciated, the operation of the piston valve 70 is controlled by the pressure differential between the front and rear sides, 72, 74, respectively, of the piston 22, and further, the pressure required to move the piston valve 70 will vary with the mass of the piston valve 70, the friction between the valve guide 112 and the inner body 104 and other factors. Thus, the angle with respect to the bottom dead center position of the piston 22 at which the piston valve 70 opens will vary with each cylinder and engine. What is important is that the piston valve 70 opens at a point in the piston stroke such that the transfer of cycle air from the piston rear side 74 to the piston front side 72 provides more cycle air for compression and combustion and improves the scavenging of combusted gases.

As the piston moves through the bottom dead center position and changes direction, the piston valve is influenced by two forces. First, as the compressed air flow through the path 82, the pressure on the piston rear side 74 drops. Further, as the connecting rod reverses the direction of motion of the piston 22 and pushes the piston 22 upward in the opposite direction, the inertia of the piston valve 70 and gravity will cause the piston valve 70 to continue its motion downward to its closed position. Normally, the piston valve 22 is moved to the closed position when the piston is approximately 55° after the bottom dead center position. After, the piston valve 70 is closed, gravity will tend to maintain the piston valve 70 in its closed position. In addition, continued upward motion of the piston 22 and the closed piston valve 70 results in a partial vacuum being formed on the rear side 74 of the piston 22. Thus, the pressure force on the piston's forward side 72 exceeds the force on the piston's rear side 74, and the piston 22 is held in its closed position. The angle at which the piston valve 70 closes will vary with the magnitude of the inertial force which is a function of the mass of the piston valve 70. Further, friction between the valve guide 112 and the inner body 104 and other factors will also influence the exact time in the piston stroke at which the piston valve 70 closes. Thus, the angle with respect to the bottom dead center position of the piston 22 at which the piston valve 70 opens will vary with each cylinder and engine. However, the piston valve 70 should remain open for a period of time that permits a flow of cycle air from the piston's rear side 74 to the piston's front side 72.

In order to compress the cycle air and pull a partial vacuum on the rear side 74 of the piston 22, it is necessary that the cylinder 12 be sealed from the chamber 84 of the crankcase 86 containing the scotch yoke 20 and crankshaft 18. A connecting rod 88 is connected at one end to the crosshead 24 of the scotch yoke 20 and is connected at its opposite end to the rear side 74 of the piston 22. A transition member or crankcase cap 92 separates a respective cylinder 14 from the crankcase 86, and the cap 92 has a bore 90 providing the only communication between the cylinders 14 and the crankcase 86. The connecting rod 88 has a straight body section 89 having a constant cross-sectional profile along its length. The length of the straight section 89 of the connecting rod 88 is longer than the stroke of the piston 22. The cross-sectional profile of the bore 90 matches but is slightly larger than the cross-sectional profile of the straight body section 89, so that the straight body section 89 passes readily through the bore. The cross-sectional profile of the bore 90 and straight body section 89 of the connecting rod 88 is normally circular but may be square, hexagonal, etc. A sealing ring 93, for example, a rubber O-ring, bears against, and sealingly engages; an external cylindrical surface of the straight section 89 of the connecting rod 88. The sealing ring 93 seals and blocks a flow of cycle air from the cylinders 14 to the crankcase chamber 84 as the connecting rod 88 is reciprocated by the piston 22.

As shown in FIG. 4, the piston 22 has a generally cylindrical outer body 94 with a plurality of grooves 96. Piston rings 98 are disposed in the grooves 96 and sealingly engage an interior wall of a respective cylinder in a known manner. The outer body 94 has a centrally located hub 100 disposed in a bore 102 in the end of the connecting rod 88. A piston inner body 104 is disposed in a bore 106 of the outer body 94 and is centrally located in the piston 22. The piston inner body 104 is rigidly secured to the piston outer body 94 and the connecting rod 88 by a fastener 108. The annular piston valve 70 is mounted on the inner body 104 and is slidable in an axial, longitudinal direction with respect to the piston 22. The annular piston valve 70 includes an annular, outer ring 110 that is attached to a valve guide 112 by fasteners 114. The outer ring 110 and valve guide 112 of the piston valve 70 slide over a guide bearing 116 that is mounted over the inner body 104 of the piston 22. The outer and inner bodies 94,104 of the piston 22 and the outer ring 110 and valve guide 112 of the annular piston valve 70 all have a common longitudinal centerline 107.

For proper operation of the piston valve 70, it is necessary that there be either no, or minimal, leakage of cycle air between the piston valve 70 and the piston 22. The relatively close tolerance between the valve guide 112 and bearing 116 as well as the length of the area of contact between the bearing 116 and valve guide 112 insures little, if any, gas leakage therebetween. A piston ring seal assembly 118 is used to provide a seal between an inner cylindrical surface 120 of the piston 22 and an outer cylindrical surface 122 of the piston valve 70. Rings 124 are mounted at the end of the piston 22 and sealingly engage the outside surface 122 of the piston valve 70. The rings 124 are supported by an annular support block 126 that, in turn, is supported in place by a wavy washer 128. The rings 124, support block 126 and washer 128 are disposed in an internal annular groove 130 in the piston 22. An annular spacer 132 is also disposed in the groove 130, and a nut 133 is threaded over, or otherwise fastened to the end of the piston 22. The piston outer body 94 is normally made of aluminum, and the piston inner body 104, the outer ring 110 and valve guide 112 are normally made of stainless steel or an R-41 steel, either of which may have a Stellite coating. As will be appreciated, other heat resistant materials can be used.

The operation of the piston valve 70 admits cycle air into the cylinder over 220° of crank angle versus 110° without the piston valve, thereby doubling the crank angle period during which cycle air is being admitted to the cylinder 12. Thus, the cycle air is compressed to a higher pressure than was possible without the piston valve 70, and the pressure ratio is increased by approximately 5%, thereby producing more power from the piston unit 12.

Further, intake of cycle air from the air intakes 34 in combination with the tapering shape of the cylinder 12 causes the combusted gas to swirl as it flows through the cylinder 12 and out the exhaust valve. While such a swirling is effective to more quickly exhaust combustion gas, the flow of combusted gas near the center of the cylinder 12 tends to lag and does not exhaust as quickly as combustion gas at the periphery of the cylinder 12. However, the annular sealing area 78 on the annular piston valve 70 is located on an inner directed conical surface 134 of the ring 104 of the annular piston valve 70. Thus, the inner conical surface 134 directs the flow path 82 of cycle air as it exits the piston 22 toward the center of the cylinder 12. That center flow of cycle air facilitates an improved exhausting and scavenging of combusted gas from the center of the cylinder 12.

Because of the requirement for minimal internal cooling, a low-pressure drop through the cylinder 14, a very high peak cylinder pressure, and hot metal temperatures, the compound engine 10 has several unique design features. First, the piston unit 12 is designed as a uniflow scavenge unit wherein the cylinder 14 and piston 22 are tapered toward the top, thereby reducing the internal volume of the combustion chamber at its upper end in order to provide several advantages. With the location of the intake ports 34 at the bottom of the cylinders and the exhaust valves 58 at the top of the cylinders, the design provides an initial swirl of the cycle air at the intake ports. The swirling pattern of the intake air continues as it rises through the cylinder 14 and accelerates as it is squeezed to a smaller and smaller diameter as it moves up the conical cylinder volume. The combustion chamber takes the shape of a small cylindrical plug with reduced surface-to-volume area ratio for a given clearance volume. These factors, along with the high temperatures of the combustion chamber surfaces, provide for a high heat release configuration. Further, the rate of heat release from the surfaces within the cylinder are greatest at those areas where the temperature is highest. In addition, the reduced volume at the upper end of the cylinder facilitates the compression ignition process. Advantageously, ignition delay is eliminated with operating surface temperatures over 1000° F.

To summarize the operating cycle, referring to FIGS. 1 and 5, with the above compound engine, high volume, low-pressure air is compressed by a total ratio of approximately 200:1. The cycle air is first compressed by a ratio of approximately 5:1 by the rotating high-pressure compressor 38 after which air flows through the combustors 42, the intake manifold 32, intake ports 34 and into the cylinders 14 of the piston units 12. The air is further compressed by a ratio of approximately 40:1 by the piston units 12 to a higher pressure at nearly one hundred percent (100%) efficiency. The compression ignites fuel injected into the cylinders 14 near the top dead center portion of the piston cycle, and the energy of the combusting and expanding gases is extracted to the maximum extent possible at nearly one hundred percent (100%) efficiency by the piston units 12 through a crankshaft rotation of approximately 95° past top dead center and an additional 30° during the opening of the exhaust valve 58. When the gases have been fully expanded in the cylinders 14 and combined with the cooling and scavenge air, they are returned through the combustors 42, to drive the high-pressure turbine 40 which, in turn, rotates the high-pressure compressor 38. Energy remaining in the exhaust gases from the piston units 12 is extracted in the low-pressure turbine 44 which is connected through the gear reduction unit 57 and a V-belt unit 59 to the output of the crankshaft 18.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, the invention is described and illustrated as being part of a two-stroke piston unit of a compound engine or unit. As will be appreciated, the piston valve of the present invention can be used in any two-stroke engine of any size.

Therefore, the invention in its broadest aspects is not limited to the specific details shown and described. Consequently, departures may be made from the details described herein without departing from the spirit and scope of the claims which follow.

What is claimed is:

1. A method of operating a two-stroke engine comprising:

moving a piston in a bore of a cylinder toward, through and away from a top dead center position at a combustion end of the cylinder;

maintaining a piston valve mounted for sliding motion in the piston closed by a greater pressure on a forward side of the piston as the piston moves toward the top dead center position;

receiving cycle air through a cycle air intake in an opposite end of the cylinder proximate a rear side of the piston;

moving the piston in the bore of the cylinder toward a bottom dead center position at the opposite end of the cylinder;

receiving cycle air into the bore of the cylinder through the cycle air intake in the combustion end of the cylinder at a forward side of the piston;

simultaneously compressing the cycle air proximate a rear side of the piston in the opposite end of the cylinder;

opening the piston valve in response to a greater pressure on the rear side of the piston as the piston moves toward the bottom dead center position;

maintaining the piston valve open in response to the greater pressure on the rear side of the piston as the piston moves through and away from the bottom dead center position to supply additional cycle air within the bore of the cylinder on the forward side of the piston, thereby improving the scavenging of combusted air from the cylinder through the exhaust valve and providing additional cycle air for compression and combustion; and closing the piston valve in response to a greater pressure on the forward side of the piston as the piston moves toward the top dead center position.

2. The method of operating a two-stroke engine of claim 1 further comprising continuing to receive cycle air in the combustion end of the cylinder through the cycle air intake at a forward side of the piston while maintaining the piston valve open.

3. The method of operating a two-stroke engine of claim 1 further comprising terminating a reception of cycle air in the combustion end of the cylinder through the cycle air intake at a forward side of the piston after maintaining the piston valve open.

4. The method of operating a two-stroke engine of claim 1 further comprising terminating a reception of cycle air in the combustion end of the cylinder through the cycle air intake at a forward side of the piston substantially simultaneously with the closing of the piston valve.

5. The method of operating a two-stroke engine of claim 1 further comprising providing a greater pressure on the rear side of the piston when the piston is approximately 55° before its bottom dead center position.

6. The method of operating a two-stroke engine of claim 5 further comprising receiving cycle air in the combustion end of the cylinder through the cycle air intake at a forward side of the piston when the piston is approximately 55° before its bottom dead center position.

7. The method of operating a two-stroke engine of claim 1 further comprising providing the greater pressure on the forward side of the piston when the piston is approximately 55° after its bottom dead center position.

8. The method of operating a two-stroke engine of claim 7 further comprising terminating a reception of cycle air in the combustion end of the cylinder through the cycle air intake at a forward side of the piston when the piston is approximately 55° after its bottom dead center position.

9. A two-stroke engine comprising:

a crankshaft;

a cylinder having an internal bore with a combustion end and an opposite end;

a piston mounted for sliding motion within the internal bore of the cylinder and operatively connected to the crankshaft, the piston having a forward side facing the combustion end of the internal bore and a rearward side facing the opposite end of the internal bore;

an intake port in fluid communication with the opposite end of the internal bore and the rearward side of the piston in response to the piston moving toward and away from the combustion end of the internal bore, and the intake port being in fluid communication with the combustion end of the internal bore and the forward side of the piston in response to the piston moving toward and away from the opposite end of the internal bore;

a piston valve mounted in the piston and providing fluid communication between the forward and rearward sides of the piston, the piston valve being opened by a pressure differential between the forward and rearward sides of the piston substantially simultaneously with the intake port being in fluid communication with the combustion end of the internal bore and the forward side of the piston; and an exhaust port.

10. The two-stroke engine of claim 9 further comprising an exhaust valve mounted at the combustion end of the internal bore.

11. The two-stroke engine of claim 9 further comprising a fuel injector in fluid communication with the internal bore of the cylinder.

12. The two-stroke engine of claim 9 wherein the piston valve is an annular piston valve.

13. The two-stroke engine of claim 9 wherein the piston valve is an annular piston valve mounted in the forward side of the piston.

14. The two-stroke engine of claim 13 wherein the piston comprises a substantially cylindrical outer body connected with a centrally located inner body, and the annular piston valve is mounted in the forward side of the piston between the outer body and the inner body.

* * * * *